US006722331B2

(12) United States Patent
Koehler et al.

(10) Patent No.: US 6,722,331 B2
(45) Date of Patent: Apr. 20, 2004

(54) VALVE CLEARANCE ADJUSTMENT MECHANISM

(75) Inventors: Scot A. Koehler, Appleton, WI (US); Karl W. Monis, Oconomowoc, WI (US); Todd L. Carpenter, Gregory, MI (US)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/262,455

(22) Filed: Oct. 1, 2002

(65) Prior Publication Data

US 2004/0000279 A1 Jan. 1, 2004

Related U.S. Application Data

(60) Provisional application No. 60/392,636, filed on Jun. 28, 2002.

(51) Int. Cl.[7] ..... F01L 1/18

(52) U.S. Cl. ..... 123/90.45; 123/90.41; 123/90.45

(58) Field of Search ..... 123/90.45, 90.52, 123/90.41

(56) References Cited

U.S. PATENT DOCUMENTS

| | | | | |
|---|---|---|---|---|
| 1,741,677 | A | 12/1929 | Brewer | |
| 1,936,653 | A | 11/1933 | Almen | 123/90 |
| 1,948,063 | A | 2/1934 | Burkhrdt | 123/98 |
| 4,369,740 | A | 1/1983 | Seidl | 123/90.45 |
| 4,438,736 | A | 3/1984 | Hara et al. | 123/90.16 |
| 4,503,818 | A | 3/1985 | Hara et al. | 123/90.16 |
| 4,643,141 | A | 2/1987 | Bledsoe | 123/90.16 |
| 5,706,769 | A | 1/1998 | Shimizu | 123/90.23 |
| 6,415,754 | B1 | 7/2002 | Hirano et al. | 123/90.43 |
| 6,439,178 | B1 * | 8/2002 | Pierik | 123/90.16 |

* cited by examiner

*Primary Examiner*—Thomas Denion
*Assistant Examiner*—Zelalem Eshete
(74) *Attorney, Agent, or Firm*—Baker & Daniels

(57) ABSTRACT

A valve clearance adjustment mechanism for use in small internal combustion engines such as, for example, side valve engines and overhead valve engines, which generally include intake and exhaust valves actuated by lifters pivotally mounted within the engine housing, which in turn are actuated by cam lobes driven in timed rotation with the crank shaft. An adjustment member is provided for mounting each lifter to a shaft, wherein the adjustment member is eccentric relative to the shaft, such that rotation of the adjustment member modifies the position of the lifter and in turn modifies the valve clearance between the lifter and the valve. After the valve clearance has been properly set, the adjustment member is fixed in position.

29 Claims, 6 Drawing Sheets

VALVE CLEARANCE ADJUSTMENT MECHANISM

CROSS-REFERENCE TO RELATED APPLICATIONS

This application claims the benefit under Title 35, U.S.C. §119(e) of U.S. Provisional Patent Application Serial No. 60/392,636, entitled VALVE CLEARANCE ADJUSTMENT MECHANISM, filed on Jun. 28, 2002.

BACKGROUND OF THE INVENTION

1. Field of the Invention.

The present invention relates to a mechanism for adjusting the clearance between a valve and a valve actuator in a small internal combustion engine of the type which are used in lawn mowers, lawn and garden tractors, sport vehicles, and other small implements.

2. Description of the Related Art.

Small internal combustion engines, such as single or two cylinder engines, include at least one intake and at least one exhaust valve per cylinder, the intake valve openable to allow an air/fuel mixture into the combustion chamber of the cylinder for combustion, and the exhaust valve openable to allow venting of exhaust from the combustion chamber after combustion. In a side valve or L-head engine, the intake and exhaust valves are typically actuated by respective lifters driven by rotating cam lobes. In an overhead valve (OHV) engine, the intake and exhaust valves are typically actuated by rocker arms connected to push rods, which in turn are actuated by lifters. In an overhead cam (OHC) engine, the intake and exhaust valves are typically directly actuated by the cam lobes of an overhead camshaft.

Regardless of the type of valve train in the engine, a small clearance space, sometimes referred to as valve lash, is desired between the end of the stem of each valve and its respective valve actuator in order to ensure that the valve is fully closed or seated at all times when the valve is not being specifically actuated for opening. If such clearance is not present, the valve may be opened or unseated slightly during the period in which the valve should normally be fully closed, thereby disrupting the internal combustion process and inhibiting engine performance.

Adjustment to achieve the proper clearance between valves and their respective actuators is typically performed during the initial construction of the engine, but may also be performed in some engines as necessary over the useful life of the engine. For example, in a side valve engine, the valve clearance is typically initially set during construction of the engines by selecting valve stems of suitable lengths. In this manner, if the valve clearance is determined by measurement to be improper, such as by measuring with a known "feeler" type gauge, a valve of a length suitable to provide the desired clearance is substituted for the valve initially installed, and the foregoing process is repeated until the desired valve clearance is achieved. In most overhead valve engines, valve clearance may be adjusted during construction of the engine, or any time thereafter, by rotating an adjustment nut at the end of the valve stem, which modifies the point of connection between the valve stem and its associated rocker arm.

What is needed is a valve clearance adjustment mechanism, particularly for side valve engines, which is an improvement over the foregoing.

SUMMARY OF THE INVENTION

The present invention provides a valve clearance adjustment mechanism for use in small internal combustion engines such as, for example, side valve engines which generally include intake and exhaust valves actuated by lifters pivotally mounted within the engine housing, which in turn are actuated by cam lobes driven in timed rotation with the crank shaft. An adjustment member is provided for mounting each lifter to a shaft, wherein the adjustment member is eccentric relative to the shaft, such that rotation of the adjustment member modifies the position of the lifter and in turn modifies the valve clearance between the lifter and the valve. After the valve clearance has been properly set, the adjustment member is fixed in position.

The adjustment members are mounted upon shafts attached to the cylinder block in an exemplary side valve engine. The adjustment members include eccentric boss portions mounted on the shafts, the boss portions in turn received within apertures of the lifters to thereby pivotally mount the lifters. The boss portions of the adjustment members are eccentric with respect to the shafts, such that rotation of each adjustment member in a first direction causes corresponding movement of the lifter which reduces the clearance between the lifter and the valve, and rotation of the adjustment member in an opposite direction causes corresponding movement of the lifter which increases the clearance between the lifter and the valve. In this manner, the adjustment member may be rotated as necessary until a proper clearance between the lifter and the valve is obtained, whereupon the position of the adjustment member may be fixed to set the proper valve clearance.

Advantageously, the present valve clearance adjustment mechanism may be used in side valve engines, for example, to adjust and set the valve clearance between the lifters and the valves, thereby obviating the need to replace individual parts in the valve train during initial assembly of the engine in order to set the proper valve clearance.

In one form thereof, the present invention provides an internal combustion engine, including an engine housing; a valve train disposed within the engine housing, the valve train including at least one valve moveable between closed and open positions, and at least one cam lobe mounted for rotation; a shaft supported by the engine housing and moveable between first and second adjustment positions; an adjustment member mounted to the shaft, the adjustment member having an eccentric portion; at least one valve actuator pivotally mounted upon the eccentric portion of the adjustment member, the valve actuator having a first portion in engagement with the cam lobe and a second portion located adjacent the valve to define a clearance space therebetween when the valve is in the closed position, wherein when the shaft is in the first adjustment position, the adjustment member may be rotated to move the valve actuator and vary the clearance space, and when the shaft is in the second adjustment position, the position of the adjustment member is fixed.

In another form thereof, the present invention provides an internal combustion engine, including an engine housing including therein at least one rotatable cam lobe, at least one valve, and at least one valve actuator periodically engaging the cam lobe to actuate the valve, wherein a clearance space is defined between the valve actuator and the valve when the lifter is not engaged by the cam lobe; and a mechanism for adjusting the clearance space, including a shaft having a head portion, the shaft adjustably securable to the engine housing between first and second positions; and an adjustment member mounted to the shaft, the adjustment member having an eccentric portion upon which the valve actuator is pivotally mounted, wherein when the shaft is in the first adjustment position, the adjustment member may be rotated upon the shaft to move the valve actuator and vary the clearance space, and when the shaft is in the second adjustment position, the adjustment member is captured between the shaft head portion and the engine housing to fix the position of the adjustment member.

In another form thereof, the present invention provides the combination of an internal combustion engine including a cam having a lobe periodically engaging a valve actuator to actuate a valve within a housing of the engine, wherein a clearance space exists between the valve actuator and the valve when the valve actuator is out of engagement with the lobe; and a valve clearance adjustment mechanism, including an eccentric adjustment member upon which the valve actuator is pivotably mounted, the adjustment member adjustable to vary the location of the valve actuator and the clearance space; and a shaft upon which the adjustment member is rotatably mounted, the shaft engageable with the engine housing to fix the rotational position of the adjustment member and thereby set the clearance space.

In a further form thereof, the present invention provides an internal combustion engine, including a cam having a lobe periodically engaging a valve actuator to actuate a valve within a housing of the engine, wherein a clearance space exists between the valve actuator and the valve when the valve actuator is out of engagement with the lobe; and a valve clearance adjustment mechanism, including a shaft supported by the engine housing; an eccentric adjustment member rotatably mounted upon the shaft and adjustably supporting the valve actuator, the adjustment member including at least one stop portion engageable with the engine housing to limit the rotation of the adjustment member such that corresponding adjustment of the valve actuator is substantially confined to movement of the valve actuator in a direction parallel to the valve.

In still further form thereof, the present invention provides a method of adjusting the clearance between a valve and a valve actuator which is pivotally mounted upon a shaft within the housing of an internal combustion engine, including the steps of adjusting an eccentric adjustment member disposed between the shaft and the valve actuator to move the valve actuator in one of a direction closer or further away from the valve to provide a desired clearance between the valve actuator and the valve; and rotating the shaft to engage the shaft with the engine housing and capturing the adjustment member in a fixed position between the shaft and the engine housing to fix the clearance between the valve and the valve actuator.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
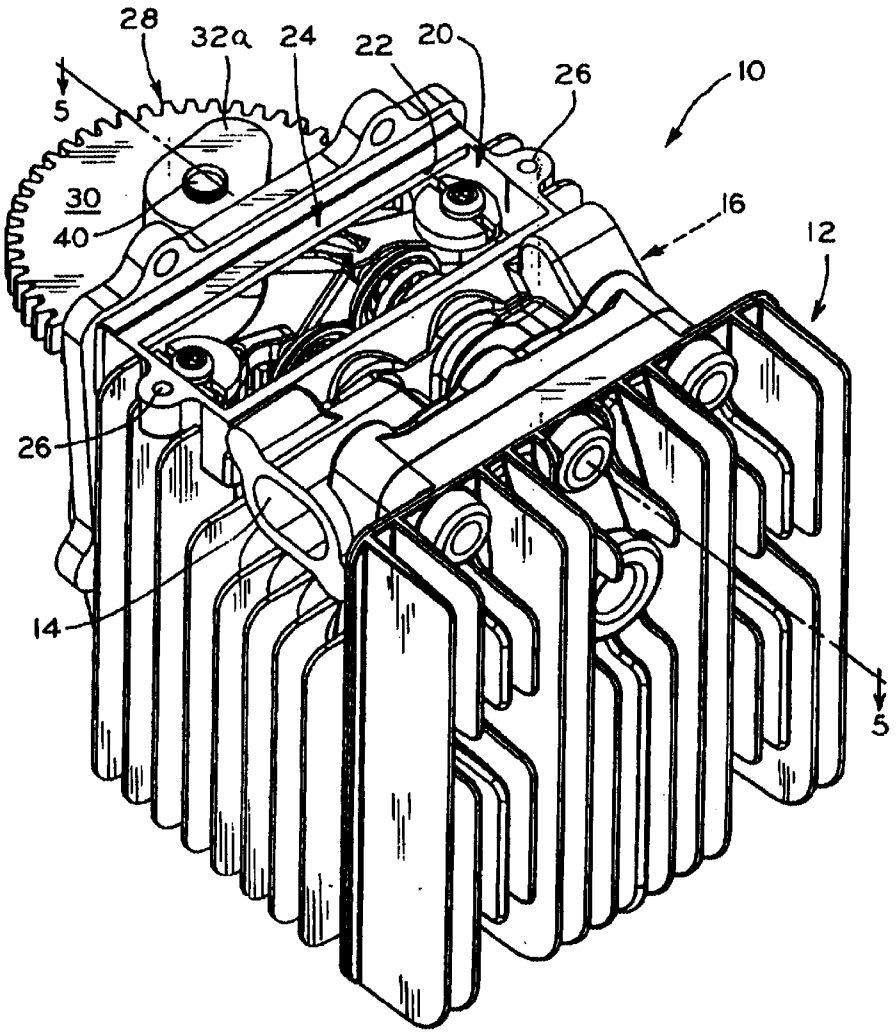
FIG. 1 is a perspective view of a cylinder block and cylinder head of a small internal combustion engine, having a valve train therein which includes a valve clearance adjustment mechanism according to the present invention.

Referring to FIG. 1, a portion of an internal combustion engine of a side valve type is shown, which may be a single or multi-cylinder engine, including cylinder block 10 and cylinder head 12 attached to cylinder block 10. The engine may be, for example, of the type disclosed in U.S. Provisional Patent Application Serial No. 60/372,560, entitled INTERNAL COMBUSTION ENGINE, filed on Apr. 15, 2002, assigned to the assignee of the present application, the disclosure of which is expressly incorporated herein by reference. Cylinder block 10 may be attached to the crankcase (not shown) of the engine in a suitable manner, such as that described in the above-incorporated U.S. Provisional Patent Application Serial No. 60/372,560. Referring to FIGS. 1 and 5, cylinder block 10 includes exhaust port 14, and intake port 16 on a side of cylinder block 10 opposite of exhaust port 14. Cylinder block 10 includes cylinder bore 18 (FIG. 4), in which a piston (not shown) is slidably disposed, which piston is in turn connected to a connecting rod and crankshaft assembly (not shown) in a known manner.

Referring to FIGS. 1 and 5, cylinder block 10 includes valve train pocket 20, which is accessible through opening 22 in cylinder block 10. Valve train pocket 20 houses the components of valve train 24 therein, as described below. Opening 22 is covered by a removable cover plate (not shown) which is attached to cylinder block 10 by fastening the cover plate to mounts 26 (FIG. 1) on cylinder block 10. The cover plate is attached to cylinder block 10 after the components of valve train 24 have been assembled and the valve clearance has been set, during initial construction of the engine, as discussed below. Also, the cover plate is removeable from cylinder block 10 in order to provide access to the components of valve train 24 for maintenance, such as adjustment of the valve clearance, for example.

Figure 2:
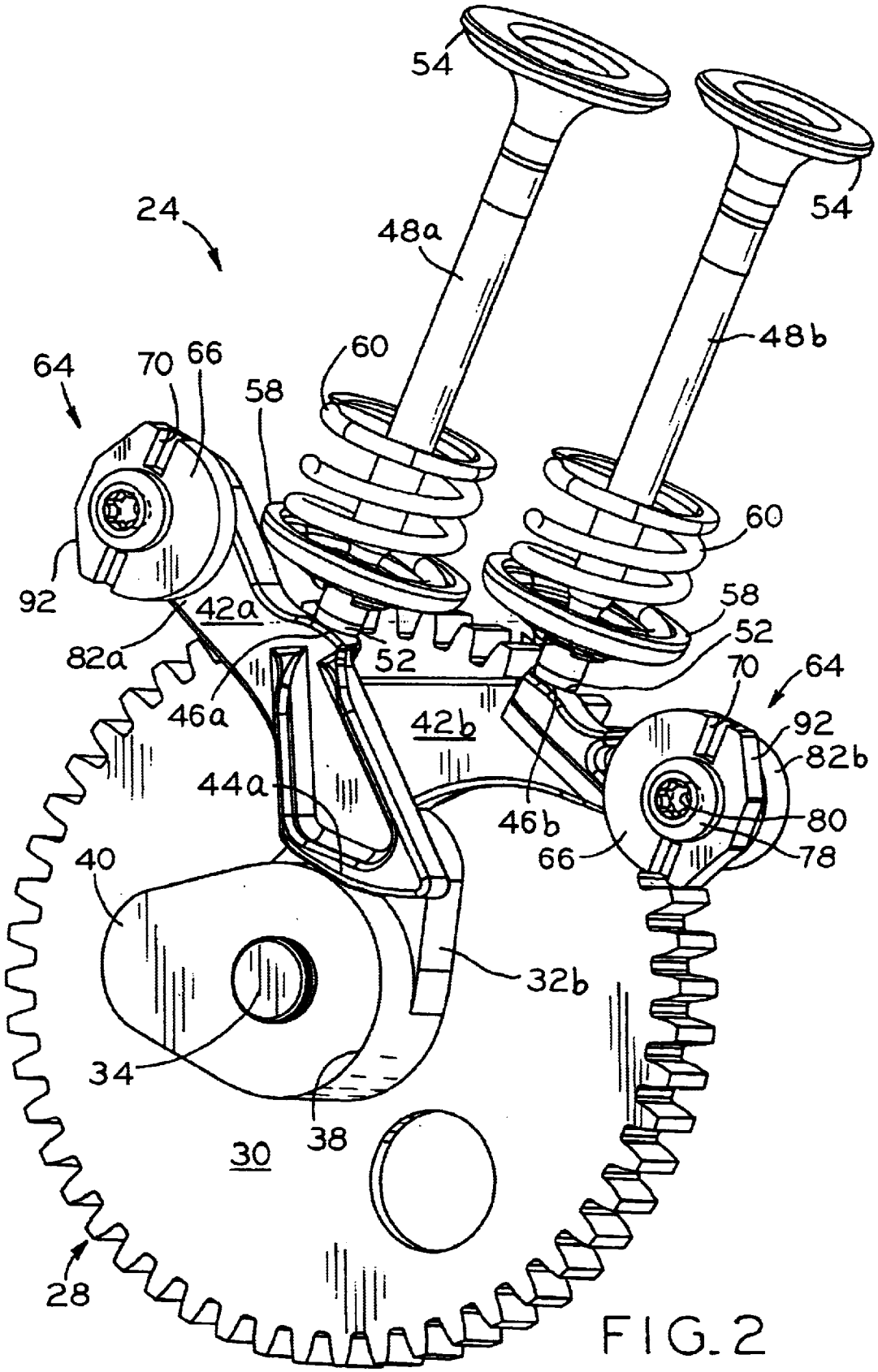
FIG. 2 is a perspective view of the valve train of FIG. 1, shown without the cylinder block and cylinder head.
Figure 3:
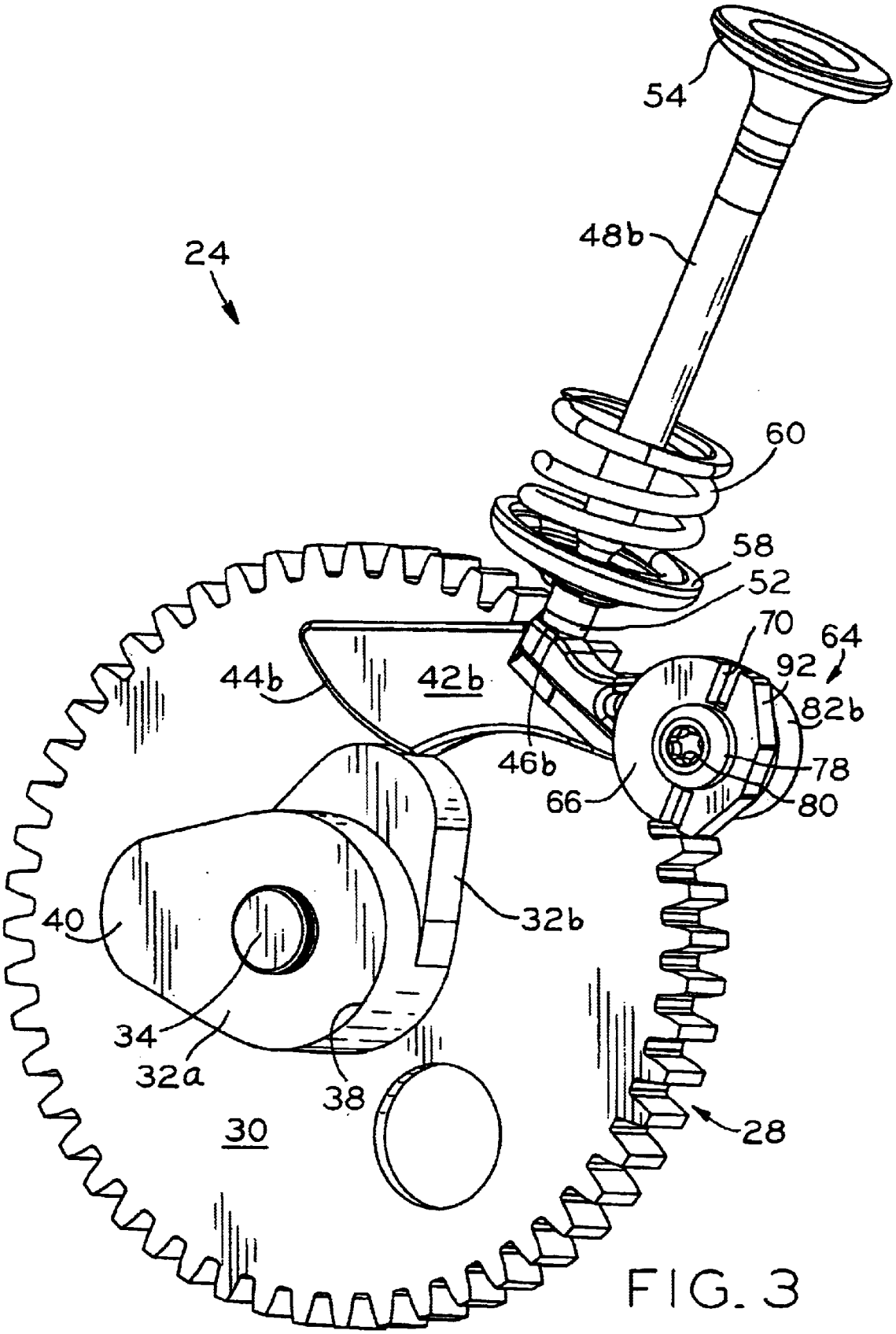
FIG. 3 is a perspective view of a portion of the valve train of FIG. 2, wherein one lifter, adjustment mechanism, and valve assembly have been omitted.
Figure 4:
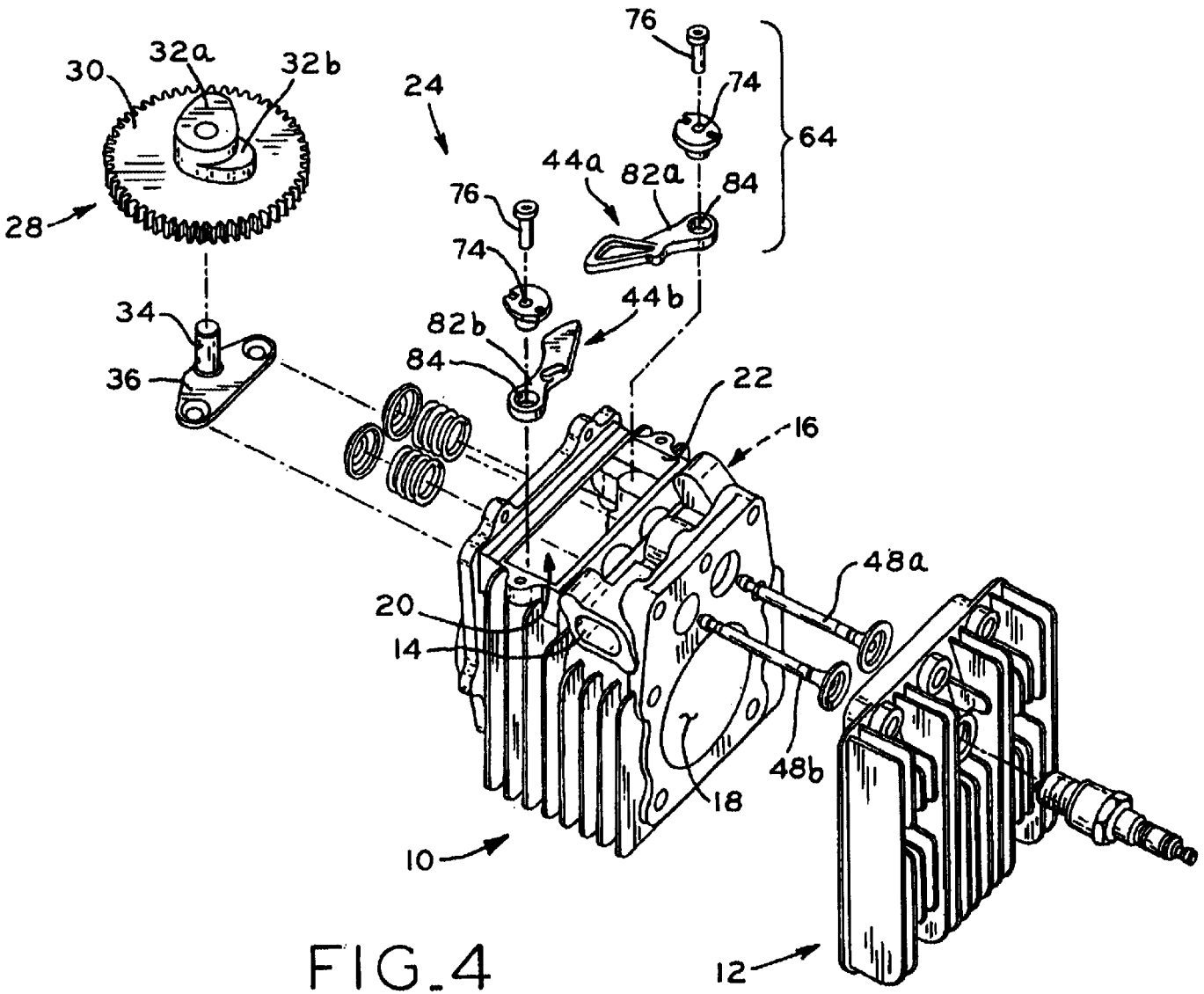
FIG. 4 is an exploded view of the engine components of FIG. 1, including the cylinder block, cylinder head, and components of the valve train.
Figure 5:
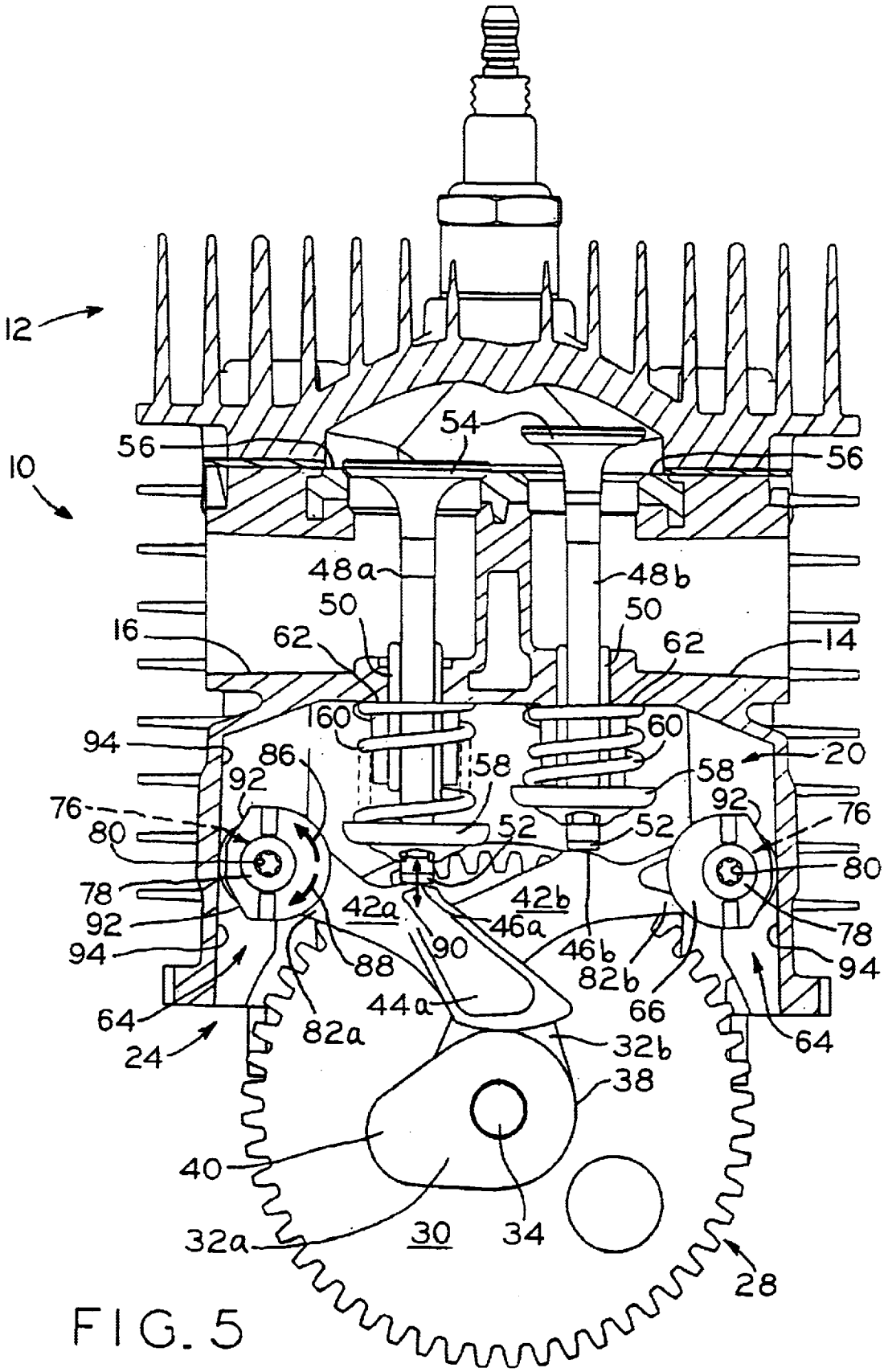
FIG. 5 is a sectional view taken along line 5—5 of FIG. 1.
Figure 6:
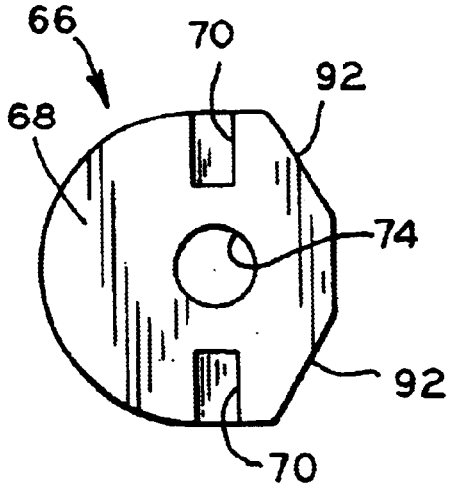
FIG. 6 is a top view of an adjustment member.
Figure 7:
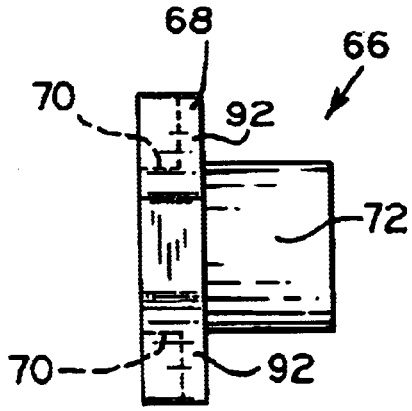
FIG. 7 is a right side view of the adjustment member of FIG. 6.

Referring to FIGS. 2–5, valve train 24 is shown, including cam gear and lobe assembly 28 in timed driven relationship with the engine crankshaft (not shown). Cam gear and lobe assembly 28 includes cam gear 30 and a pair of cam lobes 32*a*, 32*b*, which may comprise separate components attached to one another in a suitable manner. Alternatively, cam gear 30 and cam lobes 32*a*, 32*b* may be integrally formed as a single component. Referring to FIG. 4, cam gear and lobe assembly 28 is rotatably mounted upon fixed shaft 34 of plate 36, which is in turn fixedly mounted to cylinder block 10 within valve train pocket 24. Referring to FIGS. 2, 3, and 5, cam lobes 32*a*, 32*b* each include base circle 38 and lobe portion 40 which extends outwardly of base circle 38. A pair of lifters 42*a*, 42*b* are mounted to cylinder block in a manner described below, and include cam followers 44*a*, 44*b* engaging cam lobes 32*a*, 32*b*, respectively, and also include valve contact portions 46*a*, 46*b* for periodically actuating valve stems 48*a*, 48*b*, respectively, of the valves in responsive to rotation of cam lobes 32.

Referring to FIG. 5, valve stems 48*a*, 48*b* are slidably supported within valve guides 50 in cylinder block 10, and each include ends 52 for contact with contact portions 46*a*, 46*b* of lifters 42*a*, 42*b* and heads 54 which close against valve seats 56. Valve keepers 58 are attached to the upper portions of valve stems 48*a*, 48*b* near ends 52 in a known manner, and springs 60 are held under compression between valve keepers 58 and spring seats 62 of cylinder block 10 for biasing the valves to a closed position in which heads 54 seat against valve seats 56.

Desirably, the respective positions of lifters 42*a*, 42*b* are set so that a clearance of between about 0.004 and about 0.006 inches is present between contact portions 46*a*, 46*b* of lifters 42*a*, 42*b* and ends 52 of valve stems 48*a*, 48*b*; however, such clearance may be varied from the foregoing as required by the specific engine design. Generally, the foregoing clearance is necessary to ensure that valve stems 48*a*, 48*b* are biased by springs 60 such that valve heads 54 properly seat against valve seats 56 in cylinder block 10 when cam followers 44*a*, 44*b* of lifters 42*a*, 42*b* are in contact with cam lobes 32 along base circle 38. In this manner, the valves are opened only during the portion of the combustion cycle in which cam followers 44*a*, 44*b* of lifters 42*a*, 42*b* are moved outside of base circle 38 of cam lobes 32 by engagement thereof with lobe portions 40 of cam lobes 32. Additionally, if any thermal expansion of lifters 42*a*, 42*b* or valve stems 48*a*, 48*b* occurs during operation of the engine, such expansion is taken up by the valve clearance to insure that the valves properly seat when not actuated.

Also, in an overhead valve engine, drive train 24 includes a pair of push rods in the place of valve stems 48*a*, 48*b*, which push rods are actuated by lifters 42*a*, 42*b* to rotate rocker arms mounted in cylinder head 12, which rocker arms in turn actuate intake and exhaust valves in cylinder head 12 in a conventional manner. In the foregoing arrangement, a clearance is present between contact portions 46*a*, 46*b* of lifters 42*a*, 42*b* and the ends of the push rods, wherein such clearance is adjustable by valve clearance adjustment mechanism 64, which is described below. In this manner, valve clearance adjustment mechanism 64 described herein may be used with various different types of engines, including side valve engines and overhead valve engines.

Referring to FIG. 5, valve clearance adjustment mechanism 64 is provided for mounting each lifter 42*a*, 42*b* to cylinder block 10, and for adjusting the position of each lifter 42*a*, 42*b* in order to adjust the clearance between contact portions 46*a*, 46*b* of lifters 42*a*, 42*b* and ends 52 of valve stems 48*a*, 48*b*. Although valve adjustment mechanisms 64 are described herein with reference to a side valve engine, valve adjustment mechanisms 64 may also be used with engines of other valve train configurations, such as overhead valve (OHV) engines, for example.

Figure 8:
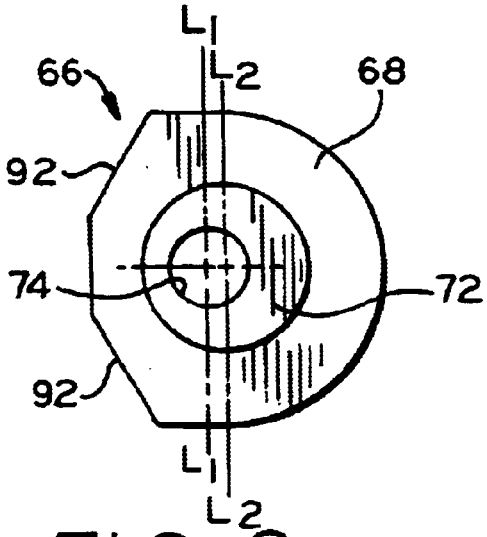
FIG. 8 is a bottom view of the adjustment member of FIG. 6.
Figure 9:
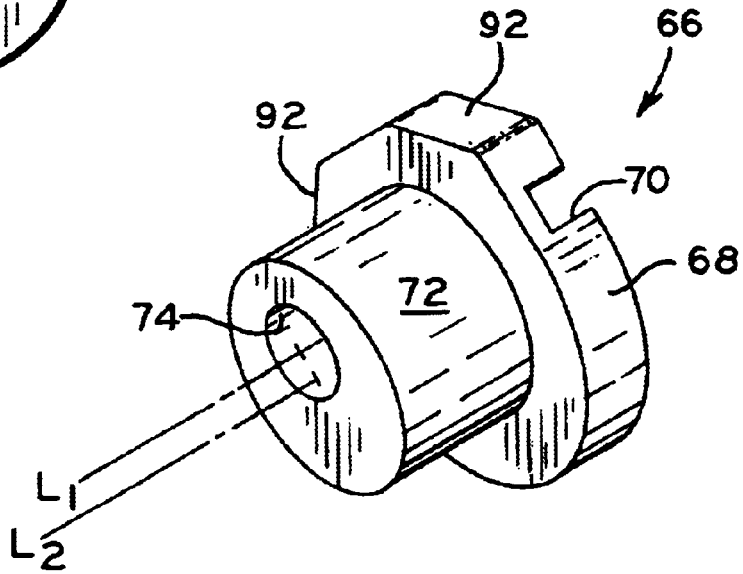
FIG. 9 is a perspective view, looking upwardly, of the adjustment member of FIG. 6.

Valve clearance adjustment mechanisms 64 each include an adjustment member 66, shown in FIGS. 6–9, which generally includes plate portion 68 having a pair of notches 70 therein, and cylindrical boss portion 72 extending from plate portion 68. Central bore 74 is disposed through plate portion 68 and boss portion 72. Referring to FIGS. 8 and 9, line $\mathbf{1}_1$-$\mathbf{1}_1$, which passes through the center of central bore 74, is not co-linear with line $\mathbf{1}_2$,-$\mathbf{1}_2$, which passes through the center of boss portion 72. Therefore, boss portion 72 is eccentric with respect to central bore 74.

Referring to FIGS. 4 and 5, a shaft 76 is inserted through central bore 74 of each adjustment member 66 and includes an end portion threaded into a corresponding hole (not shown) in cylinder block 10. Shafts 76 may be bolts, for example, including heads and threaded shank portions threadably received into cylinder block 10. Each shaft 76 includes head 78 with tool fitting 80, which may be engaged by a suitable tool (not shown) to rotate shaft 76 to thread same into the holes within cylinder block 10. In this manner, the positions of adjustment members 66 may be fixed by capturing adjustment members 66 between heads 78 of shaft 76 and cylinder block 10. As shown in FIG. 4, lifters 42*a*, 42*b* include mounting arms 82*a*, 82*b* with apertures 84 therein through which boss portions 72 of adjustment members 66 are disposed to pivotally mount lifters 42*a*, 42*b* to cylinder block 10. Thus, during operation of the engine, the positions of shafts 76 and adjustment members 66 are fixed, with lifters 42*a*, 42*b* pivotable about boss portions 72 of adjustment members 66. As discussed in more detail below, however, rotation of adjustment members 66 causes movement of lifters 42*a*, 42*b* by virtue of the eccentricity of boss portions 72 of adjustment members 66 relative to shafts 76.

In order to assemble the components of valve train 24 within cylinder block 10, valve stems 48*a*, 48*b*, valve keepers 58, and valve springs 60 are first installed within cylinder block 10 followed by installation of lifters 42*a*, 42*b*, adjustment members 66, and shafts 76 as described above. Finally, cam gear and lobe assembly 28 is mounted to cylinder block as described above.

Referring to FIG. 5, after the foregoing assembly is complete, the clearance between valve contact portions 46*a*, 46*b* of lifters 42*a*, 42*b* and ends 52 of valve stems 48*a*, 48*b* is adjusted as desired, followed by fixing the positions of adjustment members 66. A known feeler-type gauge, for example, may be used to determine whether the valve clearance is appropriate when cam followers 44*a*, 44*b* of lifters 42*a*, 42*b* are engaged with base circle 38 of cam lobes 32. If the valve clearance is appropriate, a tool (not shown) is used to tighten shafts 76 to fix the positions of adjustment members 66 and of lifters 42*a*, 42*b* with respect to their respective base circles 38 of cam lobes 32*a*, 32*b*. If however, the valve clearance is not appropriate, same may be adjusted in the following manner.

Adjustment of the valve clearance will be described referring to the adjustment member and lifter shown to the left in FIG. 5, although it should be understood the valve clearance with respect to the adjustment member and lifter shown to the right in FIG. 5 may be made in a similar manner. A suitable tool (not shown) may be engaged with notches 70 of adjustment member 66 to rotate same in either a counterclockwise direction, denoted by arrow 86, or a clockwise direction, denoted by arrow 88. Rotation of adjustment member 66 in the direction of arrow 86 moves valve contact portion 46*a* of lifter 42*a* along line 90 towards end 52 of valve stem 48*a* to reduce the valve clearance therebetween. Conversely, rotation of adjustment member 66 in the direction of arrow 88 moves valve contact portion 46*a* of lifter 42*a* away from end 52 of valve stem 48*a* to increase the valve clearance therebetween. The foregoing movement of lifter 42*a* is caused by the eccentricity of boss portion 72 of adjustment member 66 with respect to shaft 76. In this manner, the clearance between valve contact portion 46*a* of lifter 42*a* and end 52 of valve stem 48*a* may be adjusted until a desired clearance is achieved. The foregoing adjustment is performed when cam follower 44*a* of lifter 42*a* is in engagement with base circle 38 of cam lobe 32, in order to provide the desired valve clearance during the portions of the engine timing sequence when head 54 of valve stem 48*a* is seated against its valve seat 56 such that the valve is fully closed. Also, when the position of lifter 42*a* is adjusted as described above, the point of contact between cam follower 44*a* of lifter 42 with respect to cam lobe 32 usually does not change, but may change to a small extent wherein the engine timing sequence is not altered.

Flats 92 of adjustment member 66 limit the rotation of adjustment member 66 in the direction of arrow 86 or arrow 88 by contacting walls 94 of cylinder block 10. Therefore, adjustment member 66 is rotatable in the direction of arrow 86 or in the direction of arrow 88 only to a predetermined extent in order to ensure that movement of valve contact portion 46*a* of lifter 42*a* toward and away from end 52 of valve stem 48*a* is confined substantially along line 90 parallel to valve stem 48*a*.

After adjustment member 66 has been adjusted to achieve the desired clearance between contact portions 46*a* of lifters 42*a* and ends 52 of valve stems 48*a*, the position of adjustment member 66 is fixed by holding adjustment member 66 in position while rotating shaft 76 to tighten same, thereby capturing and fixing adjustment member 66 between head 78 of shaft 76 and cylinder block 10 to fix the clearance between valve contact portion 46*a* of lifter 42*a* and end 52 of valve stem 48*a*.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

an engine housing;

a valve train disposed within said engine housing, said valve train including at least one valve moveable between closed and open positions, and at least one cam lobe mounted for rotation;

a shaft supported by said engine housing and moveable between first and second adjustment positions;

an adjustment member mounted to said shaft, said adjustment member having an eccentric portion;

at least one valve actuator pivotally mounted upon said eccentric portion of said adjustment member, said valve actuator having a first portion in engagement with said cam lobe and a second portion located adjacent said valve to define a clearance space therebetween when said valve is in said closed position, wherein when said shaft is in said first adjustment position, said adjustment member may be rotated to move said valve actuator and vary said clearance space, and when said shaft is in said second adjustment position, the position of said adjustment member is fixed.

2. The engine of claim 1, including an intake valve and an exhaust valve, each said valve having an associated shaft, adjustment member, and valve actuator.

3. The engine of claim 1, wherein said shaft comprises a bolt having a head, said bolt threadably engaged with said engine housing such that, in said second adjustment position, said adjustment member is fixedly captured between said engine housing and said bolt head.

4. The engine of claim 1, wherein said adjustment member includes at least one rotation stop engagable with said engine housing to limit rotation of said adjustment member.

5. The engine of claim 1, wherein said adjustment member includes tool receiving structure.

6. An internal combustion engine, comprising:

an engine housing including therein at least one rotatable cam lobe, at least one valve, and at least one valve actuator periodically engaging said cam lobe to actuate said valve, wherein a clearance space is defined between said valve actuator and said valve when said valve actuator is not engaged by said cam lobe; and a mechanism for adjusting said clearance space, comprising:

a shaft having a head portion, said shaft adjustably securable to said engine housing between first and second positions; and an adjustment member mounted to said shaft, said adjustment member having an eccentric portion upon which said valve actuator is pivotally mounted, wherein when said shaft is in said first adjustment position, said adjustment member may be rotated upon said shaft to move said valve actuator and vary said clearance space, and when said shaft is in said second adjustment position, said adjustment member is captured between said shaft head portion and said engine housing to fix the position of said adjustment member.

7. The engine of claim 6, wherein said shaft comprises a bolt having a threaded shank extending from said head portion and threadably engaging said engine housing such that, in said second adjustment position, said bolt shank is tightened within said engine housing to fixedly capture said adjustment member between said engine housing and said bolt head.

8. The engine of claim 6, wherein said adjustment member includes at least one rotation stop engagable with said engine housing to limit rotation of said adjustment member.

9. The engine of claim 6, wherein said adjustment member includes tool receiving structure.

10. The engine of claim 6, including an intake valve and an exhaust valve, each said valve having an associated shaft, adjustment member, and valve actuator.

11. In combination:

an internal combustion engine including a cam having a lobe periodically engaging a valve actuator to actuate a valve within a housing of said engine, wherein a clearance space exists between said valve actuator and said valve when said valve actuator is out of engagement with said lobe; and a valve clearance adjustment mechanism, comprising;

an eccentric adjustment member upon which said valve actuator is pivotably mounted, said adjustment member adjustable to vary the location of said valve actuator and said clearance space; and a shaft upon which said adjustment member is rotatably mounted, said shaft engageable with said engine housing to fix the rotational position of said adjustment member and thereby set said clearance space.

12. The combination of claim 11, wherein said shaft is a bolt threadably engaging said engine housing, said bolt tightenable with respect to said engine housing to capture said adjustment member between a head portion of said bolt and said engine housing.

13. The combination of claim 11, wherein said adjustment member includes at least one rotation stop engagable with said engine housing to limit rotation of said adjustment member.

14. The combination of claim 11, wherein said adjustment member includes tool receiving structure.

15. The combination of claim 11, including an intake valve and an exhaust valve, each said valve having an associated shaft, adjustment member, and valve actuator.

16. An internal combustion engine, comprising:

a cam having a lobe periodically engaging a valve actuator to actuate a valve within a housing of said engine, wherein a clearance space exists between said valve actuator and said valve when said valve actuator is out of engagement with said lobe; and a valve clearance adjustment mechanism, comprising;

a shaft supported by said engine housing;

an eccentric adjustment member rotatably mounted upon said shaft and adjustably supporting said valve actuator, said adjustment member including at least one stop portion engageable with said engine housing to limit the rotation of said adjustment member such that corresponding adjustment of said valve actuator is substantially confined to movement of said valve actuator in a direction parallel to said valve.

17. The internal combustion engine of claim 16, wherein said shaft is adjustable between a first position in which said adjustment member is rotatable, and a second position in which the rotational position of said adjustment member is fixed to thereby set said clearance space.

18. The internal combustion engine of claim 17, wherein said shaft is a bolt threadably engaging said engine housing, said bolt capturing said adjustment member between a head portion of said bolt and said engine housing in said second position.

19. The internal combustion engine of claim 16, wherein said adjustment member includes two stop portions, one stop portion engageable with said engine housing to limit rotation of said adjustment member in a first direction, and another stop portion engageable with said engine housing to limit rotation of said adjustment member in a second direction opposite said first direction.

20. A method of adjusting the clearance between a valve and a valve actuator which is pivotally mounted upon a shaft within the housing of an internal combustion engine, comprising the steps of:

adjusting an eccentric adjustment member disposed between the shaft and the valve actuator to move the valve actuator in one of a direction closer or further away from the valve to provide a desired clearance between the valve actuator and the valve; and rotating the shaft to engage the shaft with the engine housing and capturing the adjustment member in a fixed position between the shaft and the engine housing to fix the clearance between the valve and the valve actuator.

21. The method of claim 20, including the additional steps of determining the clearance between the valve actuator and the valve before and after said rotating step.

22. The method of claim 20, wherein said adjusting step comprises rotating the adjustment member to move the valve actuator in one of a direction closer or further away from the valve.

23. An internal combustion engine, comprising:

an engine housing;

a valve train disposed within said engine housing, said valve train including at least one linkage member moveable to open and close a valve, and at least one cam lobe mounted for rotation;

a shaft supported by said engine housing and moveable between first and second adjustment positions;

an adjustment member mounted to said shaft, said adjustment member having an eccentric portion;

at least one valve actuator pivotally mounted upon said eccentric portion of said adjustment member, said valve actuator having a first portion in engagement with said cam lobe and a second portion located adjacent said linkage member to define a clearance space therebetween when said valve is closed, wherein when said shaft is in said first adjustment position, said adjustment member may be rotated to move said valve actuator and vary said clearance space, and when said shaft is in said second adjustment position, the position of said adjustment member is fixed.

24. The engine of claim 23, including an intake valve and an exhaust valve, each said valve having an associated linkage member, shaft, adjustment member, and valve actuator.

25. The engine of claim 23, wherein said shaft comprises a bolt having a head, said bolt threadably engaged with said engine housing such that, in said second adjustment position, said adjustment member is fixedly captured between said engine housing and said bolt head.

26. The engine of claim 23, wherein said adjustment member includes at least one rotation stop engagable with said engine housing to limit rotation of said adjustment member.

27. A method of adjusting the clearance between a valve linkage member and a valve actuator which is pivotally mounted upon a shaft within the housing of an internal combustion engine, comprising the steps of:

adjusting an eccentric adjustment member disposed between the shaft and the valve actuator to move the valve actuator in one of a direction closer or further away from the valve linkage member to provide a desired clearance between the valve actuator and the valve linkage member; and rotating the shaft to engage the shaft with the engine housing and capturing the adjustment member in a fixed position between the shaft and the engine housing to fix the clearance between the valve linkage member and the valve actuator.

28. The method of claim 27, including the additional steps of determining the clearance between the valve actuator and the valve linkage member before and after said rotating step.

29. The method of claim 27, wherein said adjusting step comprises rotating the adjustment member to move the valve actuator in one of a direction closer or further away from the valve linkage member.

* * * * *